United States Patent [19]

Hibino et al.

[11] Patent Number: 4,577,198

[45] Date of Patent: Mar. 18, 1986

[54] THERMAL TRANSFER PRINTER

[75] Inventors: Ikuo Hibino, Takizawa; Mikio Miyajima, Iwate, both of Japan

[73] Assignee: Alps Electric Company, Ltd., Japan

[21] Appl. No.: 644,494

[22] Filed: Aug. 24, 1984

[30] Foreign Application Priority Data

Aug. 24, 1983 [JP] Japan ..... 58-155217

[51] Int. Cl.[4] ..... B41J 31/00

[52] U.S. Cl. ..... 346/76 PH; 346/105; 400/323; 400/120

[58] Field of Search ..... 400/223, 231, 233, 235, 400/120, 240, 240.3, 217, 217.1, 240.4, 313, 224.2, 218, 323, 211, 213, 225; 101/323, 336, 96; 346/76 PH, 76 R, 137 R, 105; 219/216 PH

[56] References Cited

U.S. PATENT DOCUMENTS 3,855,448 12/1974 Hanagata et al. ..... 346/76 PH
4,250,511 2/1981 Stein et al. ..... 346/76 PH
4,294,553 10/1981 Wuthrich ..... 400/225

FOREIGN PATENT DOCUMENTS 0154193 12/1980 Japan ..... 400/120
0120385 9/1981 Japan ..... 400/211
0161188 12/1981 Japan ..... 400/213

OTHER PUBLICATIONS

IBM Technical Disclosure, "Ribbon Feed for Bidirectional Printer", by Dials et al, Sep. 1980, vol. 23, No. 4, pp. 1517–1520.

*Primary Examiner*—E. A. Goldberg
*Assistant Examiner*—A. Evans
*Attorney, Agent, or Firm*—Guy W. Shoup

[57] ABSTRACT

A thermal transfer printer comprises a platen for holding a sheet of print paper thereagainst, a thermal head movable axially along the platen in opposite first and second directions and also movable toward and away from the platen, an ink tape including a stretch facing the platen for being pressed against the sheet of print paper by the thermal head, the ink tape having a width allowing printing along a plurality of transversely spaced lines on the stretch, and means for relatively positioning the thermal head and the stretch of the ink tape selectively on one of the transversely spaced lines at a time.

7 Claims, 6 Drawing Figures

THERMAL TRANSFER PRINTER

BACKGROUND OF THE INVENTION

The present invention relates to a thermal transfer printer having a thermal head for transferring ink from an ink tape to a sheet of print paper, and more particularly to a thermal transfer printer capable of printing operation while the thermal head is reciprocally moving in opposite directions.

Various information processing apparatus such as word processors of today employ thermal transfer printers. FIG. 1 of the accompanying drawings schematically shows a conventional thermal transfer printer. The thermal transfer printer includes a platen 1 against which a sheet of print paper 2 is held. The paper sheet 2 can successively be fed along in response to rotation of the platen 1. The thermal transfer printer also has a carriage 3 reciprocally movable axially along the platen 2. The carriage 3 supports thereon a thermal head 4 and an ink tape 5 which is coiled around takeup reel 6*a* and a supply reel 6*b* that are mounted on the carriage 3.

For printing operation, the carriage 3 is first positioned at a lefthand end of its range of reciprocating movement when printing is to be started. After the paper sheet 2 has been placed in the printer, the carriage 3 is moved in the direction of the arrow. At this time, the thermal head 4 is biased toward the platen 1 so as to press the ink tape 5 against the paper sheet 2. The ink tape 5 is wound by the takeup reel 6*a* as it is fed along in a direction opposite to the direction of movement of the carriage 3. During this time, thermal dots on the thermal head 4 are selectively heated to melt a desired pattern of ink on the ink tape 5 and transfer the ink pattern from the ink tape 5 to the paper sheet 2. By selectively heating the thermal dots on the thermal head 4 in timed relation to the movement of the thermal head 4, desired characters, symbols, and/or graphic patterns of matrices of dots can be transferred to the paper sheet 2.

While the thermal transfer printer can print sharper characters or other patterns than other printers such as wire-dot printers, it has a slow printing speed. The thermal transfer printer is particularly disadvantageous in that it is incapable of printing operation while the thermal head is reciprocally moving in opposite directions unlike the wire-dot printer. Such a problem arises out of the following condition: In the thermal transfer printer, the ink tape 5 is pressed against the paper sheet 2 by the thermal head 4. During rightward movement of the carriage 3, the speed of relative movement between the platen 1 (the paper sheet 2) and the ink tape 5 must be nil at all times. If the paper sheet 2 and the ink tape 5 are moved relative to each other, they would slide against each other, with the result that the paper sheet 2 would get smeared with ink and characters to be transferred with heat from the thermal head 4 would become unclear. In addition, the ink tape 5 would be cut off under undue tension, and be liable to get wrinkled and jammed between the paper sheet 2 and the thermal head 4. For the reasons described above, the speed V of movement of the carriage 3 in one direction and the speed v of movement of the ink tape 5 in the opposite direction are equalized so that the speed of relative movement of the ink tape 5 and the paper sheet 2 will be nil.

After one line has been printed on the paper sheet 2 in the rightward direction, therefore, it is impossible to print characters in a return stroke of leftward movement of the carriage 3 while at the same time feeding the ink tape 5 in said opposite direction. It would be possible however to eliminate the speed of relative movement between the paper sheet 2 and the ink tape 5 during the return stroke of the carriage 3 by feeding the ink tape 5 in a direction opposite to that of leftward movement of the carriage 3. This would result in the reuse of the once-consumed length of the tape 5, which would print unclear characters or the like due to ink shortage.

SUMMARY OF THE INVENTION

With the prior shortcoming in view, it is an object of the present invention to provide a thermal transfer printer capable of printing clear characters during opposite strokes of reciprocating movement of a thermal head.

According to the present invention, there is provided a thermal transfer printer comprising a platen for holding a sheet of print paper thereagainst, a thermal head movable axially along the platen in opposite first and second directions and also movable toward and away from the platen, an ink tape including a stretch facing the platen for being pressed against the sheet of print paper by the thermal head, the ink tape having a width allowing printing along a plurality of transversely spaced lines on the stretch, and means for relatively positioning the thermal head and the stretch of the ink tape selectively on one of the transversely spaced lines at a time.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
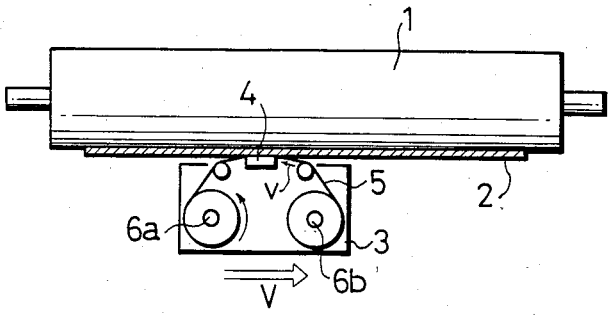
Fig.1 PRIOR ART
FIG. 1 is a plan view of a conventional thermal transfer printer.
Figure 2:
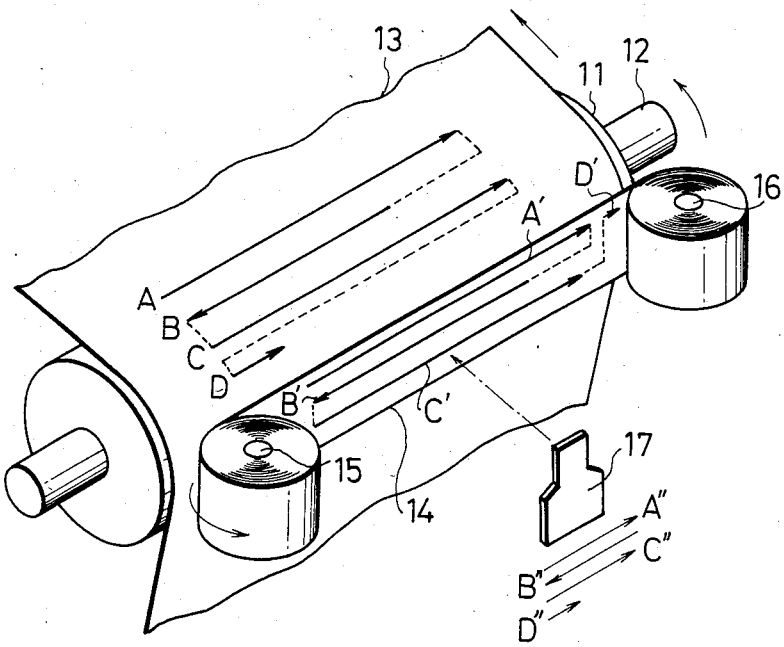
FIG. 2 is a fragmentary perspective view of a thermal transfer printer according to an embodiment of the present invention.

FIG. 2 shows a thermal transfer printer constructed in accordance with an embodiment of the present invention.

The thermal transfer printer includes a cylindrical platen 11 mounted on a horizontal shaft 12 which is driven by a stepping motor (not shown) to rotate about its own longitudinal axis. A sheet of print paper 13 is supplied from below, held against a front arcuate surface of the platen 11, and extends upwardly. The paper sheet 13 has a pair of opposite marginal edges gripped between the platen 11 and presser rollers (not shown). The paper sheet 13 can be fed along upwardly in predetermined increments to renew lines to be printed on the paper sheet 13 in response to step-like angular displacements of the platen 11 about the shaft 12.

A thermal transfer ink tape 14 is disposed in front of the paper sheet 13. The ink tape 14 is coiled around reels supported respectively on a takeup shaft 15 and a supply shaft 16 positioned substantially in confronting relation to the axial ends of the platen 11. The ink tape 14 has a renewable length or stretch extending between the reels on the takeup and supply shafts 15, 16 and facing the paper sheet 13. A thermal head 17 is disposed in confronting relation to the renewable length of the ink tape 14 remotely from the platen 11. Although the thermal head 17 is shown widely spaced from the ink tape 14, the thermal head 17 is actually positioned in slightly spaced relation to the ink tape 14. The thermal head 17 is mounted on a carriage (not shown in FIG. 2) which is driven by a stepping motor (not shown) to reciprocally move longitudinally along the platen 11 and the ink tape 14. The thermal head 17 is movable toward and away from the platen 11 by a drive mechanism mounted on the carriage. When the thermal head 17 is moved toward the platen 11, it presses the ink tape 14 against the paper sheet 13.

The ink tape 14 is of a width greater than that of conventional ink tapes so that it can print three transversely spaced lines A', B', C' in one transverse position thereon. To allow thermal dots on the thermal head 17 to selectively contact the transversely spaced positions on the ink tape 14 which correspond to the three lines A', B', C', the ink tape 14 and the thermal head 17 are relatively movable vertically as shown between three positions. To this end, the ink tape 14 may be lifted and lowered in its entirety selectively between three vertical positions for bringing the thermal dots on the thermal head 17 into confronting relation to the lines A', B', C'. Alternately, only the renewable length of the ink tape 14 which confronts the thermal head 17 may be vertically moved between the three positions. Rather than moving the ink tape 14 in a vertical sense, the thermal head 17 may be moved upwardly and downwardly between the three positions.

Printing operation of the thermal transfer printer shown in FIG. 2 is as follows:

The solid lines on the paper sheet 13 indicate characters or other patterns that have been printed, and the dotted lines indicate portions that have not been printed but represent paths which the thermal head 17 has followed.

For printing the first three lines A, B, C on the paper sheet 13, the ink tape 14 is not wound, but the same stretch of the ink tape 14 remains facing the paper sheet 13. When the line A is to be printed, the ink tape 14 is lowered or the thermal head 17 is raised to bring the thermal dots on the thermal head 17 into confronting relation to the uppermost position (corresponding to the line A') on the ink tape 14. The carriage is driven to move the thermal head 17 from the lefthand end to the right in the direction of the arrow A''. While in the range indicated by the solid-line arrow A', the thermal head 17 is moved toward the platen 11 to cause the thermal dots on the thermal head 17 to press the ink tape 14 against the paper sheet 13. During this time, the thermal dots on the thermal head 17 are selectively heated to melt a desired pattern of ink on the ink tape 14 and transfer the ink pattern from the ink tape 14 to the paper sheet 13. By selectively heating the thermal dots on the thermal head 17 in timed relation to the rightward movement of the thermal head 17, desired characters, symbols, and/or graphic patterns of matrices of dots can be transferred to the paper sheet 13. When the thermal head 17 is positioned at the righthand end of the ink tape stretch after the line A has been printed, the ink tape 14 is moved upwardly or the thermal head 17 is lowered to position the line B' on the ink tape 14 in confronting relation to the thermal dots on the thermal head 17. During this time, the platen 11 is angularly moved about the shaft 12 to advance the paper sheet 13 upwardly by one line-to-line pitch. Then, the thermal head 17 is moved to the left in the direction of the arrow B''. In the range indicated by the solid-line arrow B', the thermal dots on the thermal head 17 are moved toward the ink tape stretch to press the same against the paper sheet 13. Desired characters or the like can now be printed on the line B on the paper sheet 13 in the return stroke of the thermal head 17. After the printing of the line B is over, the thermal head 17 is spaced away from the ink tape 14, and the ink tape 14 is lifted or the thermal head 17 is lowered again to position the lowermost line C' on the ink tape 14 in confronting relation to the thermal head 17. Simultaneously, the platen 11 is angularly moved to feed the paper sheet 13 upwardly by another line-to-line pitch. Thereafter, the thermal head 17 is pressed against the ink tape 14 and the paper sheet 13, and then the thermal head 17 is moved to the right in the direction of the arrow C''. Desired characters or the like can now be printed along the line C by selectively heating the thermal dots on the thermal head 17. Upon completion of the printing of the line C, the thermal head 17 is brought away from the ink tape 14, and the carriage is moved to return the thermal head 17 to the initial position at the lefthand end of the ink tape stretch. At this time, the takeup shaft 15 is driven by a motor to wind up the ink tape stretch on which the three lines A', B', C' have been printed and introduce a new successive stretch of the ink tape 14 in front of the paper sheet 13. Concurrent with the introduction of the new ink tape stretch, the ink tape 14 is lowered or the thermal head 17 is raised to enable the uppermost line D' on the ink tape 14 to face the thermal dots on the thermal head 17, and the platen 11 is turned to feed the paper sheet 13 one pitch. Thereafter, the line D is printed in the same manner as that in which the line A has been printed. Consecutive cycles of printing operation will be performed in the same manner as described above.

Figure 3:
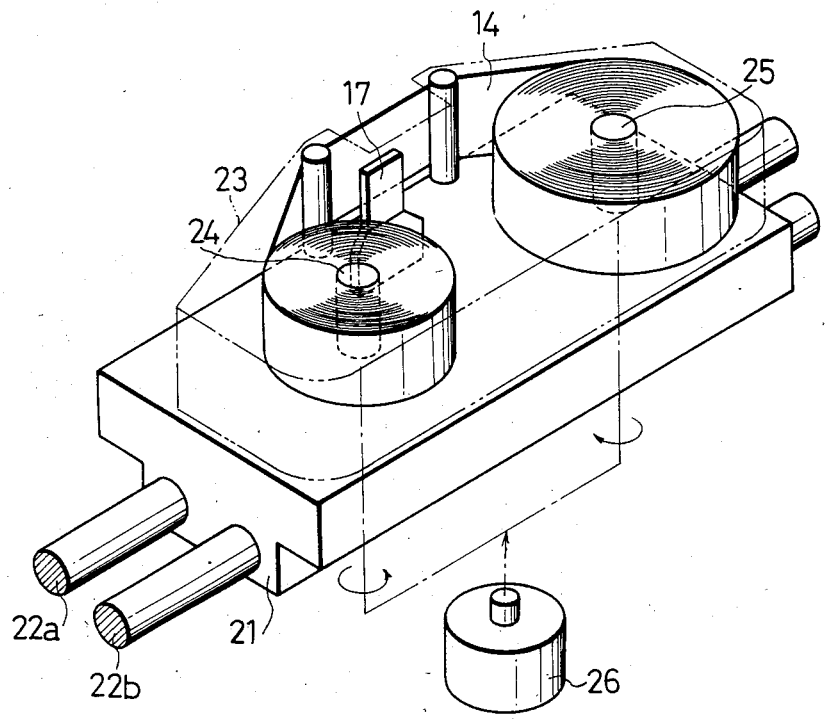
FIG. 3 is a perspective view of a carriage of a thermal transfer printer according to another embodiment of the present invention.
Figure 4:
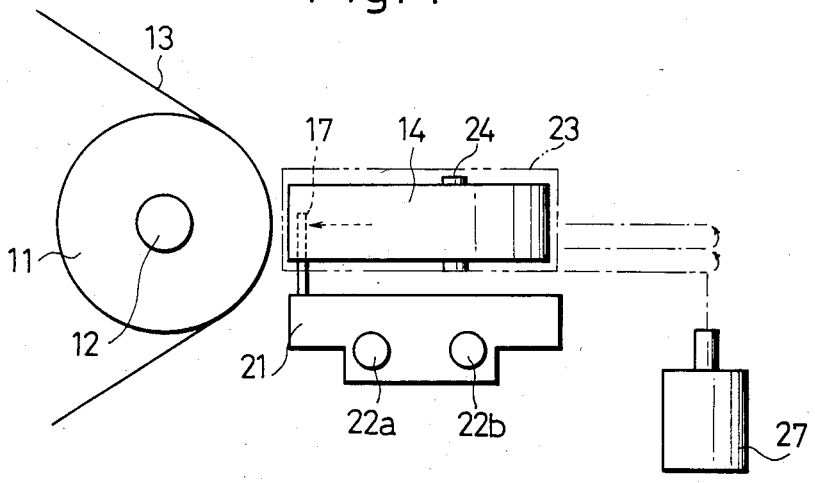
FIG. 4 is a side elevational view of the carriage shown in FIG. 3.

FIGS. 3 and 4 illustrate a thermal transfer printer according to another embodiment of the present invention.

A sheet of print paper 13 is held against a platen 11. A thermal head 17 is mounted on a carriage 21 supported on a pair of parallel carriage shafts **22*a*, 22*b* for movement along the longitudinal axis of the platen 11. The carriage 21 is reciprocally movable on and along the carriage shafts 22*a*, 22*b*** by a toothed belt (not shown) driven by a stepping motor (not shown).

In the embodiment shown in FIGS. 3 and 4, an ink tape 14 is housed in a cassette 23 mounted on the carriage 21. The thermal head 17 has a proximal end fixed to the carriage 21 and includes thermal dots supported on a distal end thereof and placed in the cassette 23 in confronting relation to a stretch of the ink tape 14. The carriage 21 accommodates therein a drive mechanism for moving the thermal head 17 selectively in a direction to press the ink tape 14 against the paper sheet 13 or in a direction to release the ink tape 14 off the paper sheet 13. The ink tape 14 is coiled around reels on takeup and rewind shafts 24, 25 which are driven by a reversible motor 26 to feed the ink tape 14 in opposite directions on the carriage 21. The speed of feeding movement of the ink tape 14 is selected to be the same as the speed of movement of the carriage 21 along the shafts 22*a*, 22*b*. Therefore, the ink tape 14 may be fed along by a rack and pinion which drives the takeup and rewind reels 24, 25 in response to movement of the carriage 21, rather than employing the motor 26. As illustrated in FIG. 4, the cassette 23 can be vertically moved between three spaced positions on the carriage 21 by a switching mechanism such as a solenoid 27.

The thermal transfer printer shown in FIGS. 3 and 4 will operate in the following manner:

As the fundamental operation is the same as that shown in FIG. 2, the reference characters A, B, C, . . . in FIG. 2 will be utilized for the description of the printing operation. When the line A (FIG. 2) is to be printed, the cassette 23 is lowered to the lowermost position to position the uppermost line A′ on the ink tape 14 in confronting relation to the thermal dots on the thermal head 17. While the thermal head 17 is pressed against the ink tape 14 and the paper sheet 13, the carriage 21 is moved in the direction of the arrow A″. At this time, the ink tape 14 is wound by the takeup shaft 24 to move the ink tape 14 in a direction opposite to the direction of movement of the carriage 21 and at the same speed as that of movement of the carriage 21, so that the speed of relative movement between the paper sheet 13 and the ink tape 14 will be nil. For printing the line B, the cassette 23 is raised to bring the central line B′ on the ink tape 14 into confronting relation to the thermal dots on the thermal head 17, and the paper sheet 13 is fed one pitch by the platen 11. The thermal head 17 is pressed against the ink tape 14 and the paper sheet 13 while the carriage 21 is moved back in the direction of the arrow B″. At this time, the ink tape 14 is wound by the rewind shaft 25 to move the ink tape 14 in a direction opposite to the direction of movement of the carriage 21 and at the same speed as that of movement of the carriage 21, so that the speed of relative movement between the paper sheet 13 and the ink tape 14 will be zero. After the printing of the line B has been completed, the cassette 23 is lifted to the uppermost position, and the carriage 21 is moved in the direction of the arrow C″, during which time the line C is printed while winding the ink tape 14 with the takeup shaft 24. After the line C has been printed, the carriage 21 is moved to the initial position at the lefthand end of the platen 11 while the takeup and rewind shafts 24, 25 are held at rest to stop feeding movement of the ink tape 14, and then the cassette 23 is lowered to the lowermost position. The thermal dots on the thermal head 17 are now positioned in confronting relation to the line D′ (FIG. 2) on a new ink tape stretch in readiness for another cycle of printing operation.

Figure 5:
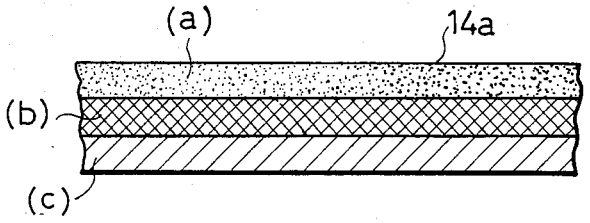
FIG. 5 is a fragmentary front elevational view of an ink tape for color printing.
Figure 6:
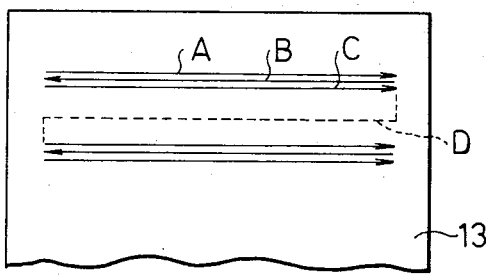
FIG. 6 is a fragmentary plan view of a sheet of print paper, illustrating a color printing mode of operation.

FIGS. 5 and 6 illustrate the use of a color ink tape. The color ink tape, designated at 14*a* in FIG. 5, is as wide as the ink tape 14 used in the foregoing embodiments, and is transversely divided into three stripes (a), (b), and (c) that are colored in three primaries, red (pink), blue, and yellow, respectively. The color ink tape 14*a* is loaded in the thermal transfer printer of the first or second embodiment, and printing operation is effected while the color ink tape 14*a* and the thermal head 17 are selectively disposed in three relative positions, so that characters or other patterns can be printed in red (pink), blue, and yellow on the paper sheet 13. Characters or other patterns can be printed in intermediate colors by not feeding the paper sheet 13 line-to-line pitches, but printing three stripes A, B, C or two stripes A, B or B, C on one line, as shown in FIG. 6.

With the present invention, as described above, an ink tape of an increased width is used and the thermal head is held in contact with the ink tape selectively in different positions on the ink tape for printing operation. This allows the thermal head to print desired characters or the like in its reciprocating strokes, with the result that the printing speed is much greater than that which the conventional thermal transfer printer has achieved. Since the thermal head is in contact with a new portion on the ink tape at all times, it can print clear characters on the paper sheet. Characters or other patterns can also be printed in desired colors with ease and in a short period of time.

Although certain preferred embodiments have been shown and described, it should be understood that many changes and modifications may be made therein without departing from the scope of the appended claims.

What is claimed is:

1. A printer comprising:

a platen for holding a sheet of print paper thereagainst;

means for advancing said platen and the print paper incrementally in successive line feeding;

a print head movable axially along said platen for bidirectional printing in opposite first and second directions;

an ink tape having a stretch thereof facing said platen for being advanced and pressed against said sheet of print paper by said print head in successive printing operations, said ink tape having a width allowing printing along at least two transversely spaced lines thereon; and means for positioning a stretch on one line of said tape in front of said print head and advancing said tape in the first direction as said print head is moved in the first direction for printing, and following a line feed of said print paper, for positioning a stretch on a second line of said tape in front of said print head and advancing said tape in the second, opposite direction as said print head is moved in the second direction for printing; and means for winding the tape a selected length after printing thereon in said first and second directions in order to bring a fresh section of said tape to a starting position for subsequent bidirectional printing.

2. A thermal transfer printer according to claim 1, including a pair of supply and takeup shafts winding said ink tape thereon and fixedly positioned respectively at axial ends of said platen, said stretch of the ink tape extending between said supply and takeup shafts.

3. A printer according to claim 1 which is a thermal printer having a thermal head and means for moving sad thermal head toward and away from said platen for the printing operations.

4. A printer according to claim 1, wherein said ink tape includes a plurality of longitudinal stripes of different colors extending respectively along said transversely spaced lines.

5. A printer according to claim 1, wherein said ink tape has a width allowing printing along three transversely spaced lines thereon in the first, the second opposite, and then the first direction of said platen.

6. A printer according to claim 5, wherein said print head and a pair of reels for advancing said ink tape is carried on a carriage, said tape being advanced in each direction in conjunction with movement of said carriage for printing, and said means for winding including means for holding the tape advancing means fixed while said print head is returned in the second opposite direction along said platen after three lines of printing in order to provide the fresh section of tape at the starting position for subsequent printing.

7. A printer according to claim 3, including a carriage reciprocally movable axially along said platen and supporting said thermal head, a pair of takeup and rewind shafts winding said ink tape on said carriage, said stretch extending between said takeup and rewind shafts, and a reversible motor for rotating said takeup and rewind shafts to feed said ink tape selectively in opposite directions at the same speed as that of movement of said carriage along said platen.

* * * * *